US005547132A

United States Patent [19]

Grogan

[11] Patent Number: 5,547,132

[45] Date of Patent: Aug. 20, 1996

[54] SPRAYER HAVING VARIABLE SPRAY PATTERN

[75] Inventor: R. Pat Grogan, Downey, Calif.

[73] Assignee: Calmar Inc., City of Industry, Calif.

[21] Appl. No.: 326,230

[22] Filed: Oct. 20, 1994

[51] Int. Cl.[6] ..... B05B 9/00

[52] U.S. Cl. ..... 239/333; 239/472; 239/492

[58] Field of Search ..... 239/332, 333, 239/472, 477, 478, 479, 492, 490, 473, 573; 222/321.7, 321.8, 383.1

[56] References Cited

U.S. PATENT DOCUMENTS

| | | | |
|---|---|---|---|
| 1,097,788 | 5/1914 | Brown | 239/473 |
| 1,202,051 | 10/1916 | Gibbons | 239/473 |
| 2,323,001 | 6/1943 | Bargeboer | 239/120 |
| 3,061,203 | 10/1962 | Kitabayashi | 239/337 |
| 3,112,074 | 11/1963 | Green | 239/573 |
| 3,129,893 | 4/1964 | Green | 239/490 |
| 3,638,867 | 2/1972 | Venus, Jr. | 239/573 |
| 3,804,296 | 4/1974 | Webster | 222/48 |
| 3,994,442 | 11/1976 | Hoening | 239/472 |
| 4,051,983 | 10/1977 | Anderson | 222/321 |
| 4,074,861 | 2/1978 | Magers et al. | 239/492 |
| 4,179,049 | 12/1979 | Umstead | 222/631 |
| 4,311,256 | 1/1982 | DeArmitt | 222/321 |
| 4,396,152 | 8/1983 | Abplanalp | 239/337 |
| 4,735,346 | 4/1988 | Stoody | 222/153 |

FOREIGN PATENT DOCUMENTS

| | | | |
|---|---|---|---|
| 340957 | 3/1960 | Switzerland | 239/573 |

*Primary Examiner*—Andres Kashnikow
*Assistant Examiner*—Lisa Douglas
*Attorney, Agent, or Firm*—Watson Cole Stevens Davis, P.L.L.C.

[57] ABSTRACT

A sprayer has a spray pattern which can be varied by the provision of a second fluid flow path which partially negates the spin velocity to produce a spray having a narrow spray cone producing spray. An opening in the spinner probe establishes the second fluid flow path from the discharge passage, and can be selectively opened and closed upon plunger rotation relative to a hollow piston stem.

25 Claims, 1 Drawing Sheet

FIG. 1
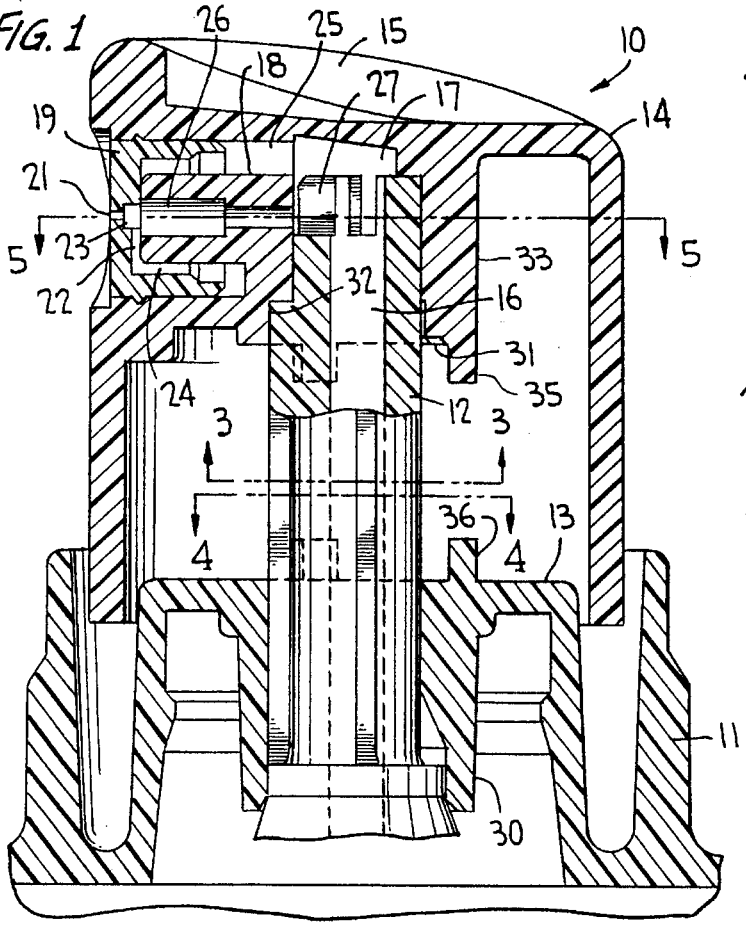
FIG. 3
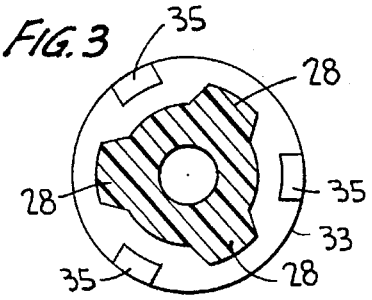
FIG. 4
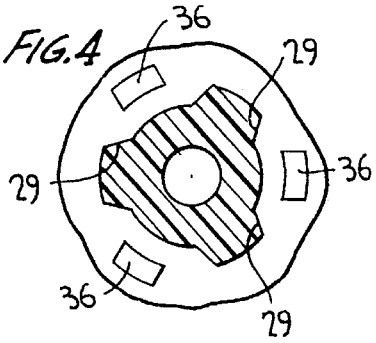
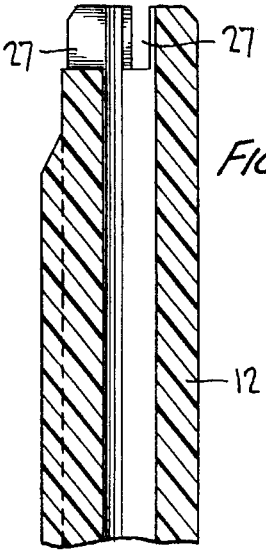
FIG. 2
FIG. 5
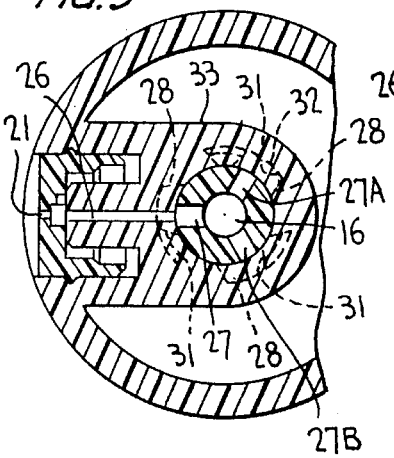
FIG. 6
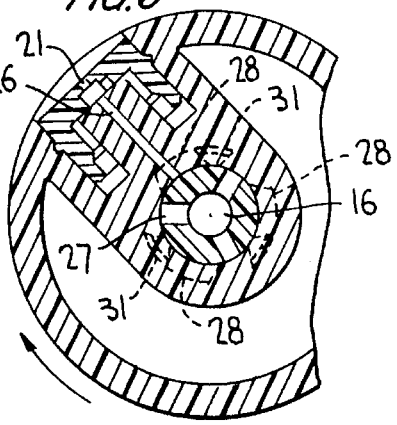
FIG. 7
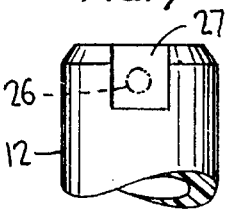
FIG. 8
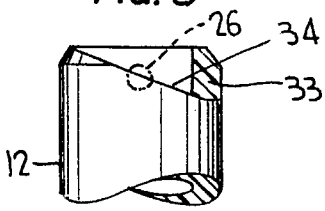

SPRAYER HAVING VARIABLE SPRAY PATTERN

BACKGROUND OF THE INVENTION

This invention relates generally to a fine mist sprayer having a reciprocable hollow piston stem on-which a fingertip actuated plunger is mounted for the pumping of fluid. Spin mechanics of some known type are provided for imparting a spin or swirl at a given velocity for issuance through the discharge orifice as a fine mist spray having a predetermined spray cone.

More particularly, the invention relates to a means establishing a second fluid flow path for diverting some of the fluid from the discharge passage to the spin mechanics to negate some of the spin velocity and thereby cause the spray to issue as a narrower spray cone. The second fluid path may be selectively opened and closed to regulate the size of the spray cone.

Known pump sprayers typically have some type of spin mechanics for imparting a spin or swirl to the fluid at a given velocity to issue through the discharge orifice as a fine mist spray which breaks up in the atmosphere in the form of a divergent spray cone of given size. For this purpose an orifice cup has a spin cheer coaxial with the discharge orifice, and tangential channels lead into the spin cheer. Longitudinal channels leading to the tangentials are formed between a post or a probe and the surrounding orifice cup to establish a flow path from the discharge passage formed in the hollow piston stem. The orifice cup and probe are mounted within a plunger head coupled to the stem for reciprocation of the stem upon manual depression of the head.

For certain applications it is desirable to provide a narrower spray cone using the existing spin mechanics structure, the less divergent spray cone satisfying the need for reducing the area of spray against a target of a given size to be wetted during pumping operation.

Also, it would be beneficial to selectively vary the size of the spray cone in a simple and efficient manner using existing spray mechanics without complicating the structure and avoiding the need for additional molded parts.

SUMMARY OF THE INVENTION

An object of the invention is to provide an improved fine mist sprayer capable of issuing a less divergent, narrower spray compared to the conventional sprayer in a simple and efficient yet highly effective manner by negating some of the tangential velocity imparted to the fluid at the discharge orifice.

In accordance with this general objective the spinner probe of a conventional fingertip sprayer has a through opening communicating with the stem discharge passage via an opening provided in the stem to establish a second fluid flow path to the downstream end of the tangentials at the spin cheer. Fluid from the discharge passage flows through a first fluid path in a conventional manner and swirls at a given velocity in the swirl chamber. Some of the fluid is diverted from the discharge passage into the second fluid flow path to negate some of the swirl velocity at the swirl chamber thereby causing the spray to issue from the orifice in a narrower, more divergent spray cone.

The plunger head may be rotated about the stem between a position misaligning the probe and stem openings for directing fluid through only the first fluid path to produce a normal fine mist spray of a given spin velocity, and a position aligning the probe and stem openings for directing fluid from the discharge passage through both fluid flow paths to produce a fluid spray of a reduced velocity and a narrower spray plume.

Cooperating means acting between the stem and a closure for the pump sprayer resists rotation of the stem upon head rotation.

Stop means acting between the piston stem and the plunger head limit head rotation to the misaligned and aligned positions.

And, limit stops on the head and/or the closure may be provided for limiting the reciprocation travel of the stem to thereby limit the output of the sprayer.

Other objects, advantages and novel features of the invention will become more apparent from the following detailed description of the invention when taken in conjunction with the accompanying drawings.

BRIEF DESCRIPTION OF THE DRAWINGS

FIG. 1 is a fragmentary vertical sectional view of a fine mist sprayer incorporating the present invention;

FIG. 2 is a fragmentary vertical sectional view of the modified piston stem of FIG. 1;

FIG. 3 is a view taken substantially along the line 3—3 of FIG. 1;

FIG. 4 is a view taken substantially along the line 4—4 of FIG. 1;

FIG. 5 is a view taken substantially along the line 5—5 of FIG. 1;

FIG. 6 is a view similar to FIG. 5 showing the plunger head rotated relative to the piston stem;

FIG. 7 is a fragmentary view of the upper end of the piston end showing one embodiment of an opening provided in the stem; and FIG. 8 is a view similar to FIG. 7 showing another embodiment of an opening provided at the upper end of the piston stem.

DETAILED DESCRIPTION OF THE INVENTION

Turning now to the drawings wherein like reference characters refer to like and corresponding parts throughout the several views, the pump sprayer is generally designated 10 in FIG. 1 as having a container closure 11 for mounting the sprayer on a container (not shown) of liquid product to be sprayed upon pumping.

Hollow stem 12 of the pump piston extends through a central opening in crown portion 13 of the closure for reciprocation within a pump cylinder (not shown) in the normal manner. A plunger head 14 is mounted on the stem to effect piston reciprocation upon application of a downward finger force applied to finger pad 15 of the plunger head against the spring bias of the piston return spring (not shown).

The hollow piston stem defines a fluid discharge passage 16 which communicates at its upper end with a lateral pathway 17 in head 14.

The head includes a laterally extending spinner probe 18 surrounded by an orifice cup 19 having a coaxial discharge orifice 21.

The inner front face of the orifice cup is provided with some type of known spin mechanics including a plurality of tangential channels 22 (only one shown in FIG. 1) terminating at the downstream end thereof in a central spin or swirl chamber 23. Longitudinal channels 24 formed between the orifice cup and probe 18 communicate with tangential channels 22 and form a first fluid path together with an annular opening 25 and lateral pathway 17, such path communicating with passage 16. The aforedescribed structure of spin mechanics and first fluid path is set forth in more detail in U.S. Pat. No. 4,074,861, commonly owned herewith.

During pumping operation product is discharged through passage 16 and the first fluid path as a fine mist spray via the spin mechanics which impart a swirl or spin to the fluid at a given velocity for issuance through the discharge orifice where the swirling particles break up in the atmosphere diverging as a spray cone or plume of a given conical size.

According to the invention some of the spin velocity is negated to produce a more narrow spray cone. This is effected by the provision of an opening 26 in probe 18 extending from the downstream end of the tangentials 22 at spin chamber 23 and terminating at piston stem 12. The piston stem is provided with at least one opening 27 which, in the FIGS. 1 and 5 position, is in alignment with opening 26 to establish a second fluid path communicating with passage 16.

During pumping upon reciprocation of the plunger in its relative position to the piston stem shown in FIGS. 1 and 5, fluid is discharged through passage 16 and through the first fluid flow path 17, 25, 24 as it is swirled in chamber 23 at a given velocity. And, during such pumping operation, some of the fluid is diverted from passage 16 into the second fluid path 27, 26 for negating some of the tangential velocity occurring in chamber 23 to effect a discharge of fluid through orifice 21 as a divergent spray having a cone size more narrow than the size of a spray cone produced by the pumping of fluid only through passage 16 and the first fluid flow path.

When the plunger head is rotated about the stem from its FIG. 5 position at which openings 26 and 27 are in alignment, to its FIG. 6 position at which openings 26 and 27 are out of alignment, any diversion of fluid through the second fluid flow path is blocked such that the discharge of fluid passes only through the first fluid flow path for issuing as a divergent spray having a normal cone size determined by the full spin velocity imparted to the fluid by the tangential channels.

To resist rotation of stem 12 upon plunger head rotation, the stem has one or more (three being illustrated in FIG. 3) external longitudinal ribs 28 of a given configuration mating with longitudinal grooves 29 (FIG. 4) of a corresponding shape located in central sleeve 30 which depends from crown piston 13 of closure 11.

And, limit stops are provided for limiting relative rotation of the plunger head between its FIG. 5 and its FIG. 6 positions. Such limit stops may be in the form of equally spaced lugs 31 extending radially inwardly from wall 32 of inner skirt 33 of the plunger head. The upper ends of ribs 28 of the stem contact one side of lugs 31 in the FIG. 5 position, and contact the other side of lugs 31 in the plunger head rotative position of FIG. 6.

It is to be noted that other openings 27A and 27B are provided at the upper end of stem 12 although only opening 27 in the illustration is aligned and misaligned with opening 26 upon plunger head rotation. Openings 27, 27A and 27B are equally spaced, and openings 27A and 27B are provided for facilitating the sub-assembly of the plunger head and the piston stem without the need for indexing. Thus, with three openings 27, three lugs 31 and three ribs 28, the plunger head can be initially oriented during assembly with the piston stem in the FIG. 5 or in the FIG. 6 position without the need for complicated indexing.

As seen in FIG. 7, each opening 27 may be in the form of an open notch having spaced, parallel side edges. Otherwise, an opening 33 may be formed at the upper end of the plunger stem which, as shown in FIG. 8, has a sloping bottom wall 34 to effect a partial blocking and unblocking of opening 26 upon relative head rotation. Thus, with the FIG. 8 embodiment, the second fluid flow path can be placed in service between a totally blocked position and a gradually open position for varying the spray cone within a range of that achieved by relative head rotation between a fully aligned FIG. 5 position and the fully misaligned FIG. 6 position.

Another feature according to the invention is the provision of limit stops for limiting stem reciprocation to thereby meter the volume of spray out of the orifice. For this purpose, depending lugs 35 may be provided on skirt 33 and/or upstanding legs 36 on crown portion 13 of closure 11. Lugs 35, if oriented to axially align with lugs 36, will bear against legs 36 at the end of the downward travel of the plunger head to thereby limit piston reciprocation and thereby meter the amount of discharge from the sprayer. If only lugs 35 are provided they will simply impact against crown portion 13 to limit the downward travel of the plunger head and piston. And, if only legs 36 are provided they will impact against the underside of sleeve 33 to limit downward travel of the plunger head and piston.

Obviously, many other modifications and variations of the invention are made possible in the light of the above teachings. For example, spin mechanics other than that illustrated and described can be provided within the scope of the invention. And, means other than ribs and grooves 28 and 29 could be provided for resisting stem rotation upon plunger rotation.

It is therefore to be understood that the invention may be practiced otherwise than as specifically described.

What is claimed is:

1. A pump sprayer having a hollow piston stem defining a single liquid discharge passage through which liquid passes upon pumping, said piston stem being reciprocable during pumping within a container closure, a plunger head mounted on said stem and having a probe extending transversely from said stem, a nozzle cap surrounding said probe, said cap having a discharge orifice and means including a spin chamber in communication with said orifice for imparting a spin at a given velocity to the liquid to be discharged through said orifice as a fine mist spray having a predetermined spray cone, said plunger head and said nozzle cap having means defining a first liquid path extending from said discharge passage to said orifice via said spin imparting means through which the liquid passes, the improvement comprising:

said probe having a through opening defining a second liquid path communicating directly with said single liquid discharge passage and with said spin chamber for likewise directing the liquid from said liquid passage through said probe opening to said spin chamber for negating the given velocity to produce a spray cone more narrow than the predetermined spray cone.

2. The sprayer according to claim 1, wherein said plunger head is relatively rotatable on said stem about a central axis thereof, an outer end of said stem having at least one opening capable of being aligned and misaligned with said probe opening for uncovering and blocking said probe opening depending on the relative rotative position of said head.

3. The sprayer according to claim 2, wherein said stem opening comprises a notch having a predetermined width.

4. The sprayer according to claim 2, wherein said stem opening comprises a notch having a tapered lower edge for gradually uncovering said probe opening upon the rotation of said plunger head to gradually regulate the size of the spray plume.

5. The sprayer according to claim 2, wherein cooperating means are provided between said stem and said closure to resist rotation of said stem upon plunger head rotation.

6. The sprayer according to claim 5, wherein said cooperating means comprises longitudinally extending ribs and grooves on said stem and said closure.

7. The sprayer according to claim 2, wherein first limit stop means is provided on said plunger head for limiting stem reciprocation to control the output of said sprayer in a given rotative position of said plunger head.

8. The sprayer according to claim 7, wherein said first limit stop means comprises at least one depending leg for contact with said closure.

9. The sprayer according to claim 7, wherein second limit stop means is provided on said closure for abutting engagement by said first limit stop means for limiting stem reciprocation.

10. The sprayer according to claim 9, wherein said second limit stop means comprises at least one upstanding leg on said closure.

11. The sprayer according to claim 2, wherein cooperating stop means are provided between said plunger head and said stem for limiting plunger head rotation into positions aligning and misaligning said stem opening and said probe opening.

12. The sprayer according to claim 11, wherein said stop means comprise radially extending spaced lugs on said plunger head and radially extending spaced ribs on said stem.

13. The sprayer according to claim 12, wherein said ribs mate with corresponding grooves provided in said closure for iresisting rotation of said stem upon head rotation.

14. A plunger sprayer comprising:

a hollow piston stem reciprocable within a container closure and defining a fluid discharge passage;

a plunger head on said stem having fluid spray means and a first fluid path extending from said discharge passage to said spray means;

said spray means including a spinner probe having a through opening terminating at said stem;

said stem having at least one opening in communication with said passage;

said plunger head being rotatable about said stem into a position misaligning said openings for directing fluid from said passage through only said first path to produce a fluid spray of a given spin velocity; and said plunger head being rotatable about said stem into a position aligning said openings for directing fluid from said passage through both said paths to produce a fluid spray of a reduced velocity compared to said given velocity and of a narrow spray plume.

15. The sprayer according to claim 14, wherein said stem opening comprises at least one notch having a given width.

16. The sprayer according to claim 14, wherein said stem opening comprises a notch having a tapered lower edge for gradual alignment with said probe opening upon head rotation to gradually regulate the size of the spray plume.

17. The sprayer according to claim 14, wherein cooperating means on said stem and said closure are provided for resisting stem rotation upon head rotation.

18. The sprayer according to claim 17, wherein said cooperating means comprise mating ribs and grooves.

19. The sprayer according to claim 18, wherein said ribs are located on said stem, and lugs are provided on said plunger head for engaging said ribs for limiting head rotation to said misaligning and aligning positions.

20. The sprayer according to claim 14,.wherein cooperating stop means are provided on said stem and said plunger HEAD for limiting head rotation to said misaligning and aligning positions.

21. The sprayer according to claim 20, wherein said stop means comprise radially spaced cooperating lugs.

22. The sprayer according to claim 14, wherein at least one first limit stop is provided on said head for limiting the reciprocation travel of said stem to thereby limit the output of the sprayer.

23. The sprayer according to claim 22, wherein said first limit stop comprises a depending leg adapted to impact said closure.

24. The sprayer according to claim 14, wherein at least one second limit stop is provided on said closure for limiting the reciprocation travel of said stem to thereby limit the output of the sprayer.

25. The sprayer according to claim 24, wherein said second limit stop comprises an upstanding leg adapted to impact said closure.

* * * * *